US005651815A

United States Patent [19]

Galloway, III et al.

[11] Patent Number: 5,651,815

[45] Date of Patent: Jul. 29, 1997

[54] ADDITIVE FOR FOUNDRY SAND PREBLENDS

[75] Inventors: Harry J. Galloway, III, Belvidere, Ill.; Alan P. Volkmar, Brillion, Wis.

[73] Assignee: Unimin Corporation, New Canaan, Conn.

[21] Appl. No.: 636,032

[22] Filed: Apr. 22, 1996

[51] Int. Cl.[6] ..... B28B 7/34; B28B 7/36

[52] U.S. Cl. ..... 106/38.28; 106/38.27; 106/38.9

[58] Field of Search ..... 106/38.27, 38.28, 106/38.9, 287.34; 75/317, 318

[56] References Cited

U.S. PATENT DOCUMENTS

| | | | |
|---|---|---|---|
| 404,238 | 5/1889 | Wilder . | |
| 973,574 | 10/1910 | Sleicher . | |
| 2,988,525 | 6/1961 | Clem | 260/225 |
| 3,023,113 | 2/1962 | Barlow | 106/38.8 |
| 3,112,206 | 11/1963 | Mocsny | 106/38.5 |
| 4,174,225 | 11/1979 | Lundgren et al. | 106/38.6 |
| 4,505,750 | 3/1985 | Cowan | 106/38.35 |
| 4,728,358 | 3/1988 | Hoffman et al. | 75/317 |
| 4,735,973 | 4/1988 | Brander | 523/139 |
| 5,215,143 | 6/1993 | Gentry | 106/38.28 |
| 5,275,114 | 1/1994 | Hughes | 106/38.3 |
| 5,333,673 | 8/1994 | Hughes | 164/528 |

*Primary Examiner*—Michael Marcheschi
*Attorney, Agent, or Firm*—William C. Crutcher

[57] ABSTRACT

An additive for foundry sand preblends providing reduced smoke and other emissions, the additive comprising a mixture of one part iron oxide, one part of a highly volatile carbonaceous material such as gilsonite, and four parts of metallurgical coke. The additive is used as one quarter of the foundry sand preblend, the other three quarters consisting essentially of clays.

5 Claims, No Drawings

ADDITIVE FOR FOUNDRY SAND PREBLENDS

Preblend compositions of binders and other proprietary materials used to make molds and cores for producing castings are well known. Typical foundry compositions include ingredients such as sodium (western) bentonite, calcium (southern) bentonite, fireclay (kaolinite), seacoal, a highly volatile carbonaceous material such as gilsonite, cereal, cellulose and/or any of the other commonly used foundry sand additives.

Foundry sands, which are composed mainly of silica sand with clays and carbonaceous materials mixed and mulled together, when compacted to form molds, resist penetration by molten metal and the tendency of the molding sand to fuse or stick to the casting. One of the problems associated with the known preblend carbonaceous additives discussed above, particularly believed due to seacoal, is the smoke and other emissions that can be environmental hazardous. These gases are released when the materials are heated in an oxygen free atmosphere.

Efforts have been made to develop foundry mold and core sands which reduce smoke and other emissions. One such patent describing a binder directed toward this object is U.S. Pat. No. 4,505,750 issued Mar. 19, 1985 to Cowan, in which a hydrophilic, organophilic, water-wettable, fibrous material is added to the binder. Another such molding material designed to reduce carcinogenic gases such as benzo(a)pyrene is disclosed in U.S. Pat. No. 4,174,225 issued Nov. 13, 1979, to Lundgren et al., wherein a hydrocarbon resinous material and porous heat-resistant inorganic material are used in place of black coal flour.

In addition to reducing smoke and other emissions, any improved additive must also preserve the quality of the metal castings and give proper finish to the castings without causing spalling or pinholes on the surface of the casting which are often caused by thermal expansion of the compacted sand or by gas generated by the mold and/or cores. Iron oxide additives, including red iron oxide (hematite, $Fe_2O_3$) are used for this purpose in additives disclosed in U.S. Pat. No. 4,735,973 issued Apr. 5, 1988, to Brander. Lastly, the use of pulverized coke in place of molding sand is shown in U.S. Pat. No. 404,238—Wilder dated May 28, 1889; cores comprising petroleum coke, petroleum asphalt and sand are disclosed in U.S. Pat. No. 973,574—Sleicher dated Oct. 25, 1910.

It would be desirable to have an improved additive for mixing with sand and clays to provide substantially reduced smoke and other emissions while giving proper finish to the castings.

Accordingly, one object of this invention is to provide an improved additive for sand foundry preblends.

Another object of the invention is to provide an improved additive for foundry sand preblends which substantially reduces smoke, benzene, and other hydrocarbon emissions during the casting process.

Still another object of the present invention is to provide an improved additive for foundry sand preblends which helps to provide a smooth finish to the surface of the metal casting.

SUMMARY OF THE INVENTION

Briefly stated, the invention comprises an improved additive for foundry sand preblends consisting essentially of a mixture of clays, the additive, and other materials. In its preferred form, the additive is a mixture of approximately one part iron oxide, approximately one part highly volatile carbonaceous material such as gilsonite and approximately four parts of metallurgical coke. Multiple parts of the additive along with cereal, cellulose and/or other commonly used materials, are intended for use as about one-quarter of the foundry sand preblend, the other three-quarters consisting essentially of clays.

DESCRIPTION

All of the materials used in the foundry green sand preblend are typical ones normally used for molding and core making with the exception of the metallurgical coke which is ground to a screen distribution similar to "D" grade seacoal. In some cases additional materials may be added as necessary. The additive replaces 100% of the seacoal requirements used in current formulas.

The additive, which is the subject of the invention comprises three materials combined together: iron oxide, a highly volatile material such as gilsonite and metallurgical coke. Either red iron oxide or black iron oxide is suitable. It is important to use metallurgical coke and not petroleum type cokes. The additive is either mixed in or used with a foundry sand preblend as a seacoal substitute. Although the ratio of one part iron oxide, one part of a highly volatile carbonaceous material such as gilsonite and four parts of metallurgical coke in the additive is a preferred ratio to reduce smoke and/or emissions and give proper finish to the castings, some variations may be permissible. When the additive is combined with the clays, the nominal percentages by weight of the preblend would be around 4% iron oxide, 4% gilsonite and 16% metallurgical coke, the balance being essentially 70% to 75% clays and small amounts of other materials.

In the case of greater than normal amounts of smoke and/or emissions, the amount of the iron oxide can be increased in steps of 0.5% of the preblend with a similar reduction in the metallurgical coke. In the case of poor shakeout peel or casting surface problems the highly volatile carbonaceous material such as gilsonite can be increased in 0.5% steps with a similar reduction in the clay portion of the preblend. The permissible ranges of constituents beyond which the additive would be less effective, expressed as a percentage by weight of the preblend, are 2%–6% iron oxide, 6%–2% gilsonite, and 12%–18% metallurgical coke.

EXAMPLE

An additive as described above was tested as a part of a preblend in the following proportions:

| | |
|---|---|
| Red iron oxide | 4.0% |
| Gilsonite | 4.0% |
| Metallurgical coke | 15.0% |
| Clays and other | balance |

The foundry sand preblend described above has had two pilot runs of two to three month duration in a gray and ductile iron production foundry operating two and three shifts a day. It was found the benzene and formaldehyde emission levels were reduced 40–55% over the prior art preblend formula using seacoal with the clay formulation. The new blend greatly reduced the generation of smoke during the casting process and in the mold cooling area. Casting finish was generally improved although there was a slight sand coating left on the casting surface at shakeout which was not felt to be a problem by foundry management.

While there is described what is considered to be the preferred embodiment of the invention, other modifications will occur to those skilled in the art, and it is desired to secure in the appended claims all such modifications as fall within the true spirit and scope of the invention.

We claim:

1. An improved additive in a foundry sand preblend, said preblend comprising said additive and clays, said additive comprising a mixture of iron oxide, gilsonite and metallurgical coke, wherein the percentages by weight, in the foundry sand preblend lie in the range of 2% to 6% iron oxide, 6% to 2% gilsonite and 12% to 18% metallurgical coke, the balance of the preblend being essentially clays.

2. An improved additive in a foundry sand preblend, said preblend comprising said additive and clays, said additive comprising a mixture of approximately 4% iron oxide, approximately 4% of a highly volatile carbonaceous material, and approximately 16% metallurgical coke, all expressed as a percentage by weight of said preblend, the balance of the preblend being essentially clays.

3. The additive according to claim 2, wherein the highly volatile carbonaceous material is gilsonite.

4. An improved additive for foundry sand preblends, said additive consisting essentially of a mixture, by weight, of approximately one part iron oxide, approximately one part a highly volatile carbonaceous material and approximately four parts metallurgical coke.

5. The additive according to claim 4, wherein the highly volatile carbonaceous material is gilsonite.

* * * * *